US006951044B2

(12) United States Patent
Kaim

(10) Patent No.: US 6,951,044 B2
(45) Date of Patent: Oct. 4, 2005

(54) PAPER CLEANING BUFF

(76) Inventor: Wayne K. Kaim, W10980 Lake View Dr., Lodi, WI (US) 53555

( * ) Notice: Subject to any disclaimer, the term of this patent is extended or adjusted under 35 U.S.C. 154(b) by 259 days.

(21) Appl. No.: 10/072,863

(22) Filed: Feb. 9, 2002

(65) Prior Publication Data

US 2003/0150482 A1 Aug. 14, 2003

(51) Int. Cl.[7] ..... A47L 5/38
(52) U.S. Cl. ..... 15/308; 15/309.1; 15/102; 101/425
(58) Field of Search ..... 15/309.1, 308, 15/102, 230.17, 230.19, 256.5; 101/425

(56) References Cited

U.S. PATENT DOCUMENTS

| | | | | |
|---|---|---|---|---|
| 1,071,519 A | * | 8/1913 | Hanish | 15/230.19 |
| 1,530,930 A | * | 3/1925 | Burch | 15/230.19 |
| 1,943,874 A | | 1/1934 | Moe | |
| 1,945,274 A | * | 1/1934 | Hormel | 15/102 |
| 3,246,357 A | * | 4/1966 | Ammons | 15/230.17 |
| 3,635,158 A | | 1/1972 | Budinger | |
| 3,800,349 A | | 4/1974 | Green | |
| 4,263,745 A | | 4/1981 | Salahshour | |
| 4,647,029 A | | 3/1987 | Ohmori | |
| 4,715,078 A | | 12/1987 | Howard et al. | |
| 4,989,293 A | * | 2/1991 | Bashyam | 15/383 |
| 5,163,369 A | | 11/1992 | Hawitt | |
| 5,568,986 A | | 10/1996 | Sugai | |
| 5,611,281 A | | 3/1997 | Corrado et al. | |
| 5,642,670 A | | 7/1997 | Takeuchi | |
| 5,675,856 A | | 10/1997 | Itzkowitz | |
| 6,006,843 A | | 12/1999 | Corrado et al. | |
| 6,120,864 A | | 9/2000 | Chiricosta et al. | |
| 6,125,496 A | | 10/2000 | Stevens, Jr. | |
| 6,142,076 A | | 11/2000 | Corrado et al. | |
| 6,178,589 B1 | | 1/2001 | Kaim | |
| 6,237,176 B1 | | 5/2001 | Egoshi et al. | |
| 2003/0046785 A1 | * | 3/2003 | Shiroki et al. | 101/425 |

OTHER PUBLICATIONS

Edward H. Best & Co.—Felts and Fabric Products, print out from web site, 4 pp, © 1999 Edward H. Best & Co.

* cited by examiner

*Primary Examiner*—Theresa T. Snider

(57) ABSTRACT

A paper cleaning apparatus employs a paper buffing roll which has a lightweight hollow cylindrical core mounted between stub shafts. The stub shafts are mounted to bearings and the hollow core is arranged to be driven at approximately 3,450 to approximately 4,450 RPM. The surface of the cylindrical core is given a rough surface over which a wool cloth jacket is placed. The cloth sleeve is clamped in place by retaining end caps which fit over the stub shafts and clamp the sleeve against the ends of the hollow cylindrical core. The cloth sleeve is shrunk onto the surface of the cylindrical core with hot water or steam. The cloth sleeve is frayed to form a soft outer surface, with radially extending fibers.

20 Claims, 2 Drawing Sheets

PAPER CLEANING BUFF

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present application relates to apparatus for cleaning a moving paper web in general and particularly to cleaners which affect the boundary layer of air moving with the paper web.

In a typical web offset press an image to be printed is transferred to a rubber blanket which is brought into contact with a moving web of paper onto which the image is printed. Minute amounts of loose fiber and dust from the paper web stick to the rubber blankets so that over time the blankets become dirty and must be cleaned to maintain image quality. It has been found that the frequency with which the rubber printing blankets must be cleaned can be substantially decreased if the paper web is precleaned before it is printed upon. In my earlier patent, U.S. Pat. No. 6,178,589, which is incorporated herein by reference, I disclosed an apparatus for cleaning the web which used an old but effective type of web cleaning roll. This existing web cleaning roll consisted of a central steel core on which multiple disks of cloth were compressed to form the roll surface. The surface of the roll, i.e. the cloth material was frayed to form a soft outer surface which is then worn in against a moving web. To effectively clean the web, an interaction between the cleaning rolls is uniformly established with the boundary layer of air which attaches to a moving web. This boundary layer which attaches to the paper web is only a small fraction of an inch thick. An ordinary web cleaner using only vacuum to remove fibers and dust from a paper begins to be ineffectual as paper speeds increase above 800 feet per minute (13 fps) because the boundary layer of air which moves with the paper web becomes more difficult to penetrate.

The buffing rolls are operated at relatively high speeds and, because of space limitations and overall cost, are relatively narrow in diameter—typically between three-and-one-half inches and four-and-one-half-inches in diameter. The fabric rings of the prior buffing rolls were constructed with only relatively narrow diameter cores, for example about 1.5 inches in diameter for a buff diameter of 4 inches. The same buffing rolls typically have a length of between 20 and 60 inches. The construction of the prior art buffing rolls which employ a solid central steel core overlain with disks of cloth results in some difficulty in assuring proper balance so that the cleaning rolls do not vibrate. If the central core is made too large in diameter, it can be difficult for maintenance people to handle the cleaning rolls. Further, renewing the soft outer surface of the rolls requires returning the rolls to the factory with the added cost of shipping to and from the factory.

What is needed is a paper cleaning roll which is lighter, stiffer, and which has a surface which can be renewed more readily.

SUMMARY OF THE INVENTION

The paper cleaning apparatus of this invention employs a paper buffing roll which has a lightweight hollow cylindrical core mounted between stub shafts. The stub shafts are supported by bearings and the hollow core is arranged to be driven at approximately 3,450 to approximately 4,450 RPM. The surface of the cylindrical core is given a rough surface over which a wool cloth jacket is placed. The cloth jacket is clamped in place by retaining end caps which fit over the stub shafts and clamp the jacket against the ends of the hollow cylindrical core. The cloth jacket is shrunk onto the surface of the cylindrical core with hot water or steam. The cloth jacket is teased to raise fibers on the to form a soft outer surface.

It is a feature of the present invention to provide a paper cleaning apparatus with a buffing roll which may be easily resurfaced.

It is a further feature of the present invention to provide a paper cleaning apparatus with a buffing roll which is less subject to damage.

It is another feature of the present invention to provide a paper cleaning apparatus with a buffing roll which is less subject to vibration.

It is yet another feature of the present invention to provide a paper cleaning apparatus with a buffing roll which is intrinsically stiffer.

Further objects, features and advantages of the invention will be apparent from the following detailed description when taken in conjunction with the accompanying drawings.

DESCRIPTION OF THE PREFERRED EMBODIMENTS

Figure 1:
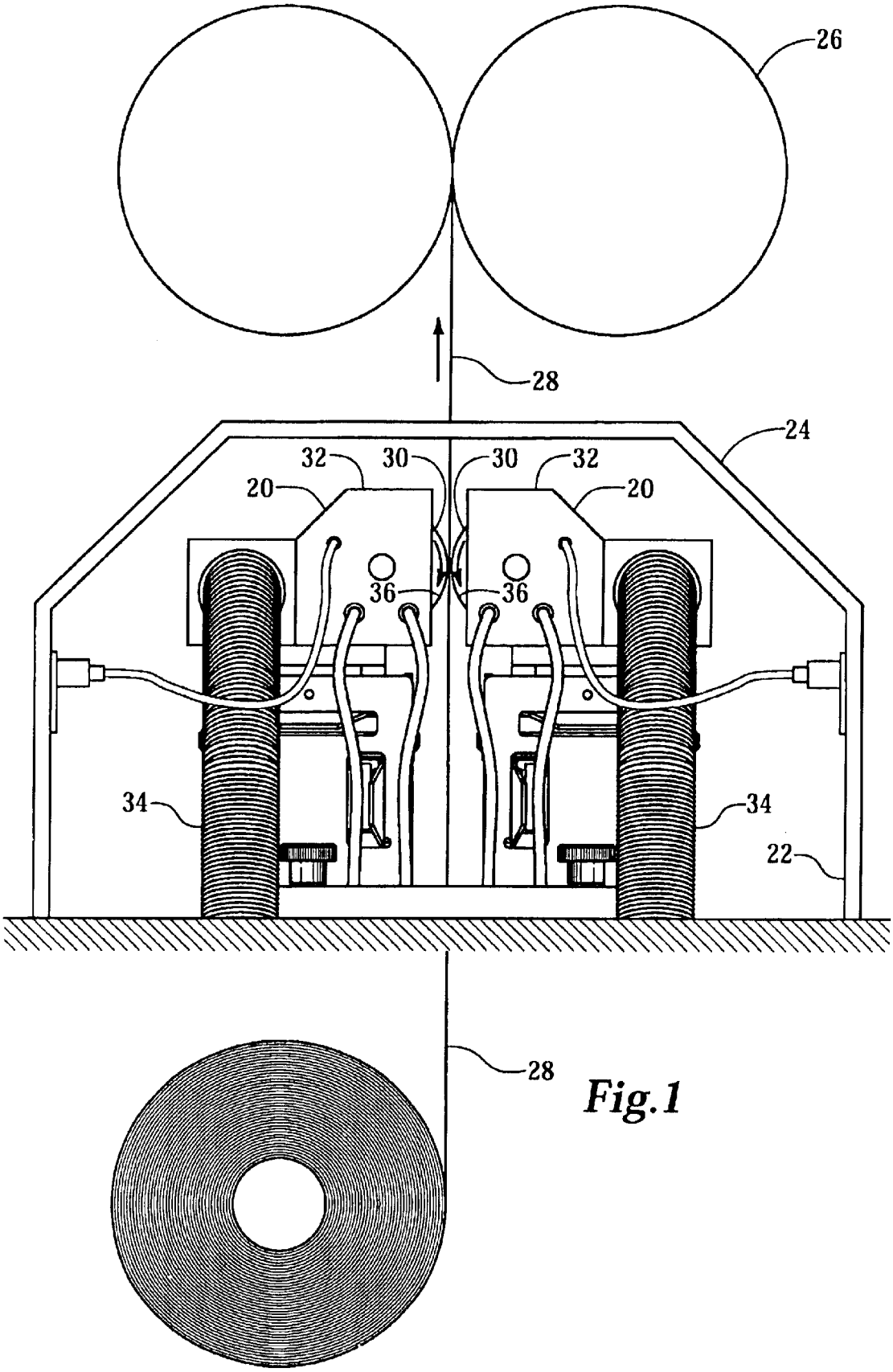
FIG. 1 is a side elevational view of a paper cleaning apparatus incorporating the buffing rolls of this invention, placed by way of example in a printing press archway.
Figure 2:
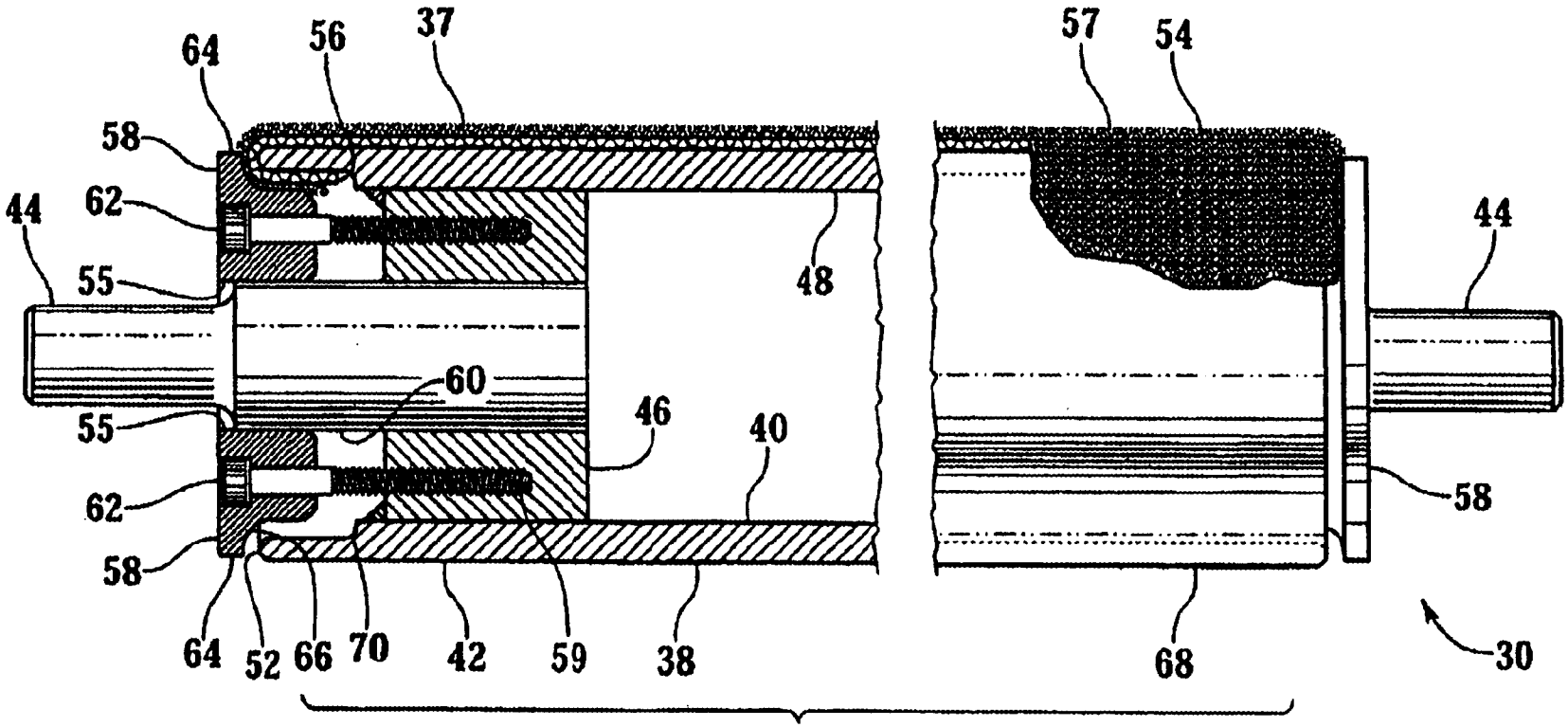
FIG. 2 is an side elevational view, partially broken away in section, and partly cut away, of a buffing roll of the apparatus of FIG. 1.

Referring more particularly to FIGS. 1–2, wherein like numbers refer to similar parts, a pair of buffing machines 20 are shown in FIG. 1, positioned within an archway 22 formed by a frame 24 of a printing press 26. A paper web 28 passes between opposed buffing rolls 30 which are mounted within vacuum hoods 32 which are connected to vacuum hoses 34. The buffing rolls 30 are rotated while air is drawn through the hoods 32. The rolls are rotated towards each other (one in the clockwise direction and one in the counter clockwise direction) in operation. As shown in FIG. 2, the buffing rolls 30 have a soft surface 36 composed of a profusion of radially extending wool fibers 37 which present a hairy surface. The fibers 37 and the air currents create or interact with the boundary layer of air moving with the paper web 28, causing lose paper fibers and dust containing various components such as clay, starch or fiber particles to becoming entrained in the boundary layer attached to the buffing roll surface 36. The trapped particles are subsequently removed from the buffing roll 30 by a vacuum supplied by the hoses 34 to the vacuum hoods 32.

As shown in FIG. 2, the lightweight buffing roll 30 is constructed from a thin-walled cylinder 38 with a hollow interior 40. In the case of a 3½-inch diameter thin-walled aluminum cylinder 38 has walls 42 which are approximately ⅜th inches thick, and is joined to two opposed stainless steel stub shafts 44. The stub shafts 44 are sweated to aluminum plugs 46 which are then welded or bonded to the inside diameter 48 of the cylinder 38. Sweating refers to the process where one part is expanded by heating relative to another part and assembled so that when both parts are at the same temperature an interference fit is produced. Each stub shaft 44 has a thicker diameter portion 60 as shown in FIG. 2.

The aluminum plugs 46 are spaced inwardly of the cylinder ends 52, which are counterbored such that the radiused cylinder ends 52 which project outwardly from the plugs have a diameter of 3/16 inches. A wool jacket 54, about one-quarter inch in thickness, is placed around the cylinder 38, and the ends 56 of the wool jacket 54 are wrapped about the cylinder ends 52 which are radiused to prevent cutting of the wool jacket 54. The wrapped ends 56 of the jacket 54 are clamped to the cylinder 38 by metal caps 58. Each cap 58 has a central bore 55 which slides along the thicker diameter portion 60 of the stub shafts 44. Four equally spaced screws 62 extend through the end caps 58 and into threaded holes 59 in the aluminum plugs 46. Tightening the screws 62 draws the caps 58 axially inwardly toward the plugs 46.

The end caps 58 have radially protruding circumferential flanges 64 which define circumferential radiused features 66 opening towards the ends 52 of the cylinder 38. The ends 56 of the wool jacket 54 are clamped between the flanges 64 and the cylindrical edges 52, to be held in place within the circumferential radiused features 66. The wool sleeve or jacket 54 is approximately one-quarter inch in radial thickness and initially fits easily over the surface 68 of the aluminum cylinder 38. The wool jacket 54 is heated with steam or hot water and dried. This process causes the wool jacket 54 to shrink and grip the aluminum cylinder 38 tightly and to become affixed to the surface without bonding thereto. Following the shrinking process the ends 56 of the wool jacket 54 are bent over the cylindrical edges 52 and clamped in place by the end caps 58. The surface 68 of the aluminum cylinder 38 may be shot peened to produce a rough surface to which the wool jacket 54 attachment is enhanced when the wool fibers in the jacket shrink. The jacket may be a tubular woven cloth material, for example woven essentially of wool. A suitable wool jacket may be obtained from Edward H. Best & Co., Hanover, Mass., particularly All Wool Endless Jacket products.

The wool jacket 54 has an outer surface 57 from which multiple radially extending fibers 37 project. The number of radially extending fibers 37 may be increased by teasing or brushing the surface 57 of the roll 30 with, for example, a wire brush. In use, the ends of the fibers 37 should be tangent to the web 28. Correct positioning of the fibers 37 with respect to the web 28 is accomplished by positioning the rolls so that they contact the paper web 28 and allowing the paper web over a period of four to twenty-four hours to seat in or wear away the fibers which actually frictionally engage the surface of the paper web 28, after which the buffing rolls 30 can be considered to be in noncontact with the paper web, because no further wearing against the paper occurs. The buffing roll surface 57 is noncontact with the moving paper web. Surface 57 moves in a direction opposite to the direction of the paper web 28. In practice a gap between the roll surface 57 and the paper web 28 of as much as a 1/32th or even 1/16th of an inch, will not prevent the cleaning action.

To create the proper buff boundary layer of air it is important that the surface velocity of the roll surface 36 be approximately in the range of 60 to 80 fps, in a direction opposite that of the paper web 28 which is moving typically at a velocity in excess of 25 fps to typically about 40 fps. For a roll with a total diameter of approximately four inches, this implies a rotation speed of between 3,450 RPM and 4,600 RPM. For a buffing roll 30 with an overall diameter of four and one half inches, the rotational speed may be proportionately about 12½ percent less. Rotating a cylinder sixty or more inches long at upwards of 4000 RPM without significant vibration is difficult. The tendency of a rotating core to vibrate depends on the square root of the spring constant of the system divided by the mass of the system.

By increasing the diameter of the core over the prior art and substantially decreasing the mass by constructing the core of lightweight materials and by making the core hollow, the buffing roll is rendered substantially stiffer and substantially of lower mass, thus increasing the spring constant, of the spring mass system which represents the spinning core, and decreasing the mass. Increasing the spring constant and decreasing the mass both contribute to decreased vibration.

To replace the the wool jacket 54, the screws 62 are loosened to allow the end caps 58 to slide away from the edges 52 of the roll cylinder 38 and unclamp the ends 56 of the wool jacket 54. Once the old wool jacket 54 is no longer clamped at its ends, it is removed by slitting it axially with a utility knife. A new jacket is then slid over the surface 68 of the aluminum cylinder. The wool jacket 54 is heated with steam or hot water and dried. This process causes the wool jacket 54 to shrink and grip the aluminum cylinder. Following the shrinking process, the ends 56 of the wool jacket 54 are bent over the cylindrical edges 52 and clamped in place by the end caps 58. The surface 36 of the roll 30 is then developed as necessary by wire brushing, and the buffing rolls 30 are installed and worn in.

It should be understood that the roll could be constructed of any relatively strong lightweight material, particularly a composite hollow core could be used, in particular one constructed of graphite epoxy. Other roll surface coatings or jackets of other fibers could be used, either natural plant or animal fibers or synthetic fibers. Various methods of clamping or otherwise holding a fiber jacket to the surface of the roll could be employed.

It should also be understood that the buffing rolls 30 should be balanced to a relatively high degree. The balancing of rotating or spinning objects is well understood by those skilled in the art. The rolls 30 shown in FIG. 2 may, for example, be balanced by removing material from the aluminum plugs 46 along the radial surface 70 through which the threaded holes 59 are drilled, although other techniques known to those skilled in the art could be used.

It should be understood that the term "thin-walled" when used to describe a cylinder or pipe is used in its ordinary technical meaning of a wall thickness which is less than or around 1/10 the diameter of the cylinder or pipe.

It should be understood that two buffing rolls 30 may be placed opposite each other as shown in FIG. 1 to clean both sides of the paper web 28 or a single buffing roll may be positioned opposite a backing roll to clean one side of a paper web. A second single buffing roll opposite a second backing roll can then be used to clean a second side of the paper web.

It should be understood that the vacuum hood 32 preferably will include a number of vacuum slots which are positioned adjacent axially extending bars which closely approach the surface 36 of the buffing rolls 30 and interact with the boundary layer of the buffing roll to knock fibers and dust from the buffing roll. These bars may be spaced at 60, 90 or 180 degrees from the point at which the roll 30 is tangent to the web 28, and oriented tangent or perpendicular to the buffing roll 30.

It is understood that the invention is not limited to the particular construction and arrangement of parts herein illustrated and described, but embraces all such modified forms thereof as come within the scope of the following claims.

I claim:

1. An improved web cleaning apparatus, comprising:

a rotatable first web buffing roll;

a rotatable second web buffing roll adjacent to the first web buffing roll; and a web passing between the first web buffing roll and the second web buffing roll, wherein the improvement comprises:

each of the first and second web buffing rolls comprising:

a hollow core having:

an outer surface, and stub shafts on which that web buffing roll rotates, an outer surface of each stub shaft engaging an inner surface of the hollow core, and a jacket positioned tightly about the outer surface and clamped between opposed end caps to ends of the hollow core, the jacket having a soft outer surface having a profusion of protruding fibers.

2. The improved web cleaning apparatus of claim 1, wherein, for each of the first and second web buffing rolls, the jacket extends continuously around the outer surface.

3. The improved web cleaning apparatus of claim 1, wherein, for each of the first and second web buffing rolls, an axial length of the hollow core is substantially greater than a diameter of the hollow core.

4. The improved web cleaning apparatus of claim 1, wherein, for each of the first and second web buffing rolls, that web buffing roll is positioned relative to the web such that the profusion of protruding fibers do not contact the web.

5. An improved web cleaning apparatus, comprising a rotatable web buffing roll adjacent to a web, the web buffing roll enclosed within a hood connected to a vacuum system, wherein the improvement comprises:

the web buffing roll comprising:

a hollow core having:

a core surface, and stub shafts on which the web buffing roll rotates, and a jacket positioned tightly about the hollow core, the jacket being held to, but not bonded to, the core surface and having a soft outer surface having a profusion of outwardly projecting fibers, and wherein the web buffing roll is positioned relative to the web such that the profusion of outwardly protruding fibers do not contact the web.

6. The improved web cleaning apparatus of claim 5, wherein the jacket extends continuously around the outer surface.

7. The improved web cleaning apparatus of claim 5, wherein an axial length of the hollow core is substantially greater than a diameter of the hollow core.

8. A method of cleaning a web using a web cleaning device comprising:

a rotatable first web buffing roll, comprising:

a hollow core having:

an outer surface, and stub shafts on which the first web buffing roll rotates, an outer surface of each sub shaft engaging an inner surface of the hollow core, and a jacket positioned tightly about the outer surface and clamped between opposed end caps to ends of the hollow core, the jacket having a outer surface and having a profusion of protruding fibers extending from the outer surface of the jacket, the jacket being continuous at least along an axis of the hollow core;

a rotatable second roll adjacent to the first web buffing roll, the web positioned between the first web buffing roll and the second roll; and at least one vacuum hood connected to a vacuum system, one vacuum hood associated with the first web buffing roll, the method comprising:

passing the web between the first web buffing roll and the second roll in a first direction, a first boundary layer of an ambient atmosphere moving with the web in the first direction;

rotating the first web buffing roll such that a portion of the first web buffing roll adjacent the web moves in a direction opposite the first direction, a second boundary layer of the ambient atmosphere moving with the first web buffing roll;

without contacting the web with the first web buffing roll, interacting at least with one of the protruding fibers or the second boundary layer with at least one of the web or the first boundary layer to transfer loose materials from at least one of the web or the first boundary layer into at least one of the second boundary layer or the jacket;

removing the transferred loose materials from at least one of the second boundary layer or the jacket using the at least one vacuum hood and vacuum system, comprising operating the first web buffing roll within the vacuum hood, while drawing a vacuum on the vacuum hood and rotating the first web buffing roll to produce an effective surface velocity of the first web buffing roll to clean the web.

9. The method of claim 8, wherein the the effective surface velocity of the first web buffing roll is at least approximately 60 fps.

10. The method of claim 8, further comprising replacing the jacket, comprising:

removing the first web buffing roll from the associated one of the at least one vacuum hood;

removing the jacket from around the hollow core;

placing a new jacket around the hollow core;

shrinking the new jacket until the new jacket tightly engages the the outer surface of the hollow core;

developing a profusion of fibers extending from the new jacket;

placing the first web buffing roll within the associated one of the at least one vacuum hood;

drawing a vacuum on that vacuum hood and rotating the first web buffing roll;

contacing a surface of the web with the extending fibers to wear the extending fibers so that the extending fibers no longer frictionally engage the surface of the web.

11. A method of cleaning a surface of a web wherein the web is moving in a first direction, the method comprising:

rotating a roller at a surface velocity of at least about 60 feet per second in a direction opposite the first direction, the roller comprising:

a hollow core having:

an outer surface, and stub shafts on which the roller rotates, an outer surface of each sub shaft engaging an inner surface of the hollow core; and a jacket positioned tightly about the outer surface of the hollow core and clamped between opposed end caps to ends of the hollow core, the jacket having a outer surface and having a profusion of protruding fibers extending from the outer surface of the jacket, the jacket being continuous at least along an axis of the hollow core;

placing the the jacket in close tangential engagement to the surface of the web to allow the profusion of protruding fibers extending from the outer surface of the jacket to interact with a boundary layer carried along with the web to remove particles from at least one of the surface of the web or the boundary layer carried along with the web.

12. An improved paper web cleaning apparatus, comprising:

a rotatable first web buffing roll;

a rotatable second web buffing roll adjacent to the first web buffing roll; and a web passing between the first web buffing roll and the second web buffing roll, wherein each of the first and second web buffing rolls comprise:

a hollow core having:

a outer surface, and stub shafts on which that web buffing roll rotates, an outer surface of each stub shaft engaging an inner surface of the hollow core, and a jacket positioned tightly about the outer surface and clamped between opposed end caps to ends of the hollow core, the jacket having a soft outer surface and having a profusion of protruding fibers.

13. The improved web cleaning apparatus of claim 12, wherein, for each of the first and second web buffing rolls, the jacket extends continuously around the outer surface.

14. The improved web cleaning apparatus of claim 12, wherein, for each of the first and second web buffing rolls, an axial length of the hollow core is substantially greater than a diameter of the hollow core.

15. The improved web cleaning apparatus of claim 12, wherein, for each of the first and second web buffing rolls, that web buffing roll is positioned relative to the web such that the profusion of protruding fibers do not contact the web.

16. An improved web cleaning apparatus, comprising a rotatable web buffing roll adjacent to a web, the web buffing roll enclosed within a hood connected to a vacuum system and comprising:

a hollow core having:

a core surface, and stub shafts on which the web buffing roll rotates, and a jacket positioned tightly about the hollow core, the jacket being held to, but not bonded to, the core surface and having a soft outer surface having a profusion of outwardly projecting fibers;

wherein the web buffing roll is positioned relative to the web such that the profusion of outwardly protruding fibers do not contact the web.

17. The improved web cleaning apparatus of claim 16, wherein the jacket extends continuously around the outer surface.

18. The improved web cleaning apparatus of claim 16, wherein an axial length of the hollow core is substantially greater than a diameter of the hollow core.

19. A method of cleaning a web using a web cleaning device comprising:

a rotatable first web buffing roll, comprising a hollow core having:

an outer surface, and stub shafts on which the first web buffing roll rotates, and a jacket positioned tightly about the outer surface and clamped between opposed end caps to ends of the hollow core, the jacket having a outer surface and having a profusion of protruding fibers extending from the outer surface of the jacket, the jacket being continuous at least along an axis of the hollow core;

a rotatable second roll adjacent to the first web buffing roll, the web positioned between the first web buffing roll and the second roll; and at least one hood connected to a vacuum system, at least one hood associated with the first web buffing roll, the method comprising:

passing the web between the first web buffing roll and the second roll in a first direction, a first boundary layer of an ambient atmosphere moving with the web in the first direction;

rotating the first web buffing roll such that a portion of the first web buffing roll adjacent the web moves in a direction opposite the first direction, a second boundary layer of the ambient atmosphere moving with the first web buffing roll;

interacting the protruding fibers with the first boundary layer to transfer loose materials from the web or first boundary layer into the second boundary layer or jacket;

removing the transferred loose materials from at least one of the second boundary layer and the jacket using the at least one hood and vacuum system.

20. A method of cleaning a web using a web cleaning device, comprising:

passing a web between a first web buffing roll and a second roll in a first direction, a first boundary layer of an ambient atmosphere moving with the web in the first direction, wherein:

the first web buffing roll is rotatable and comprises:

a hollow core having:

an outer surface, and shafts on which the first web buffing roll rotates, an outer surface of each shaft engaging an inner surface of the hollow core, and a jacket positioned tightly about the outer surface of the hollow core and clamped between opposed end caps to ends of the hollow core, the jacket having a outer surface and having a profusion of protruding fibers extending from the outer surface of the jacket, the jacket being continuous at least along an axis of the hollow core, and the web cleaning device includes at least one vacuum hood connected to a vacuum system, each vacuum hood associated with one of the first web buffing roll or the second roll;

rotating the first web buffing roll such that a portion of the first web buffing roll adjacent the web moves in a direction opposite the first direction, a second boundary layer of the ambient atmosphere moving with the first web buffing roll;

interacting at least one of the protruding fibers and the second boundary layer with the first boundary layer to transfer loose materials from at least one of the web or first boundary layer into at least one of the second boundary layer or jacket;

removing the transferred loose materials from at least one of the second boundary layer or the jacket using the at least one vacuum hood and vacuum system.

* * * * *